United States Patent [19]

Fabrig

[11] Patent Number: 4,662,816

[45] Date of Patent: May 5, 1987

[54] METHOD OF BREAKING UP STACKS OF PAPER SHEETS OR THE LIKE

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 889,608

[22] Filed: Jul. 28, 1986

Related U.S. Application Data

[63] Continuation of Ser. No. 417,589, Sep. 13, 1982, abandoned.

[30] Foreign Application Priority Data

Apr. 1, 1982 [DE] Fed. Rep. of Germany ..... 3212086

[51] Int. Cl.[4] ..... B65G 59/06

[52] U.S. Cl. ..... 414/786; 414/115; 414/128; 414/907; 414/50; 271/165; 271/220; 33/147 R

[58] Field of Search ..... 414/50, 786, 114, 115, 414/125, 128, 907; 271/160, 165, 220; 33/147 R, 147 E

[56] References Cited

U.S. PATENT DOCUMENTS

| | | | |
|---|---|---|---|
| 3,055,516 | 9/1962 | Mead | 414/115 X |
| 3,176,859 | 4/1965 | Prager | 414/114 |
| 3,690,475 | 9/1972 | Praffle | 414/115 |
| 3,866,765 | 2/1975 | Stobb | 414/114 X |
| 3,996,667 | 12/1976 | Barnard | 414/114 X |
| 4,030,528 | 6/1977 | Horning | 414/114 X |
| 4,079,512 | 3/1978 | Lakes | 414/114 X |
| 4,313,703 | 2/1982 | Fabrig | 414/115 |

FOREIGN PATENT DOCUMENTS 2225063 12/1973 Fed. Rep. of Germany .

*Primary Examiner*—Frank E. Werner
*Attorney, Agent, or Firm*—Peter K. Kontler

[57] ABSTRACT

Stacks which are about to be subdivided by a sword-like tool at a dividing station are monitored by a spring-biased mechanical sensor which causes the generation of signals serving to change the position of the stack at the dividing station with reference to the tool and/or vice versa if the monitored height deviates from an anticipated height so that the tool divides the stack into piles of desired height. The sensor monitors the stacks ahead of the dividing station.

7 Claims, 1 Drawing Figure

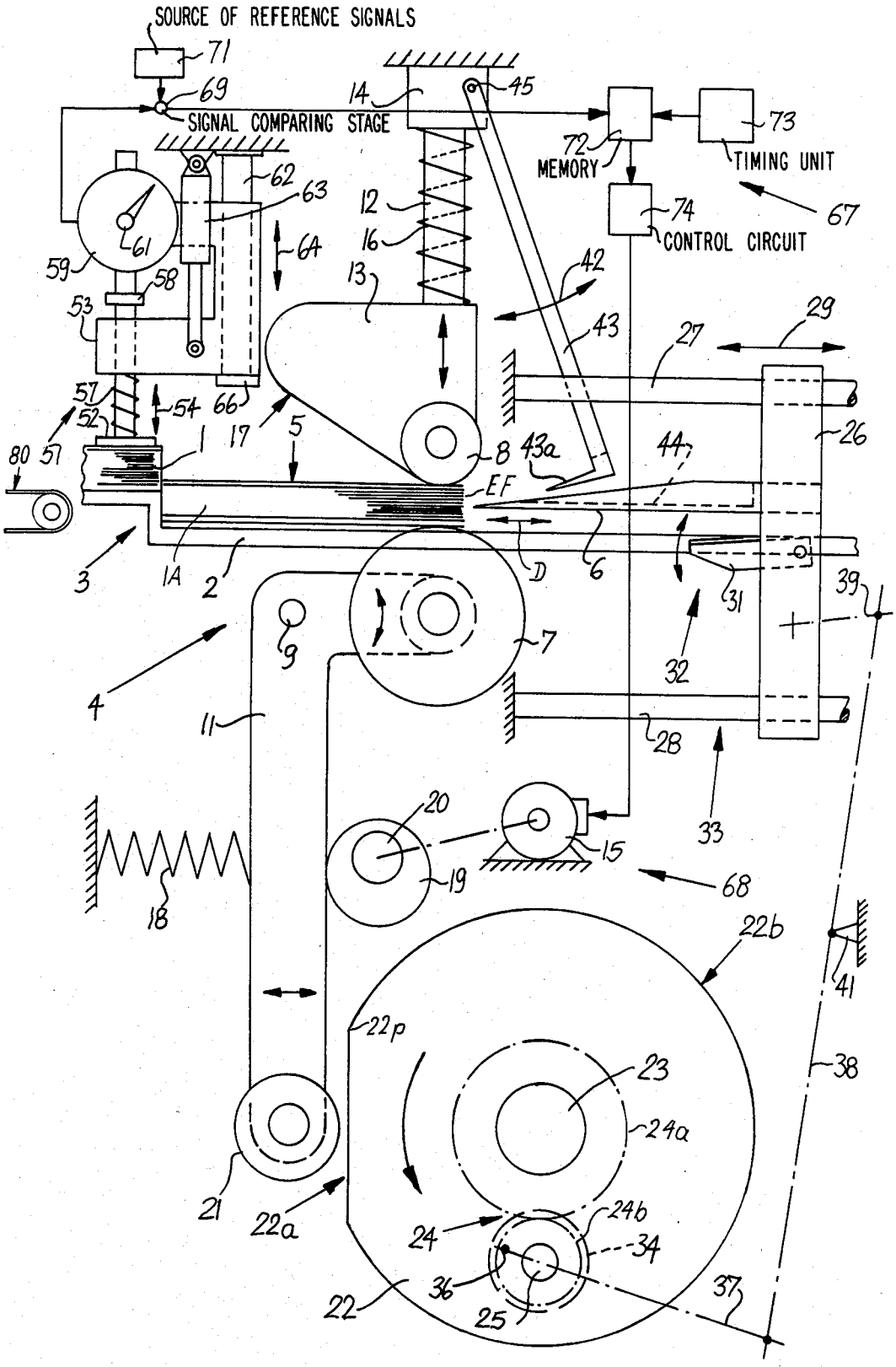
SOURCE OF REFERENCE SIGNALS
SIGNAL COMPARING STAGE
MEMORY
TIMING UNIT
CONTROL CIRCUIT

METHOD OF BREAKING UP STACKS OF PAPER SHEETS OR THE LIKE

This application is a continuation of application Ser. No. 417,589, filed Sept. 13, 1982, now abandoned.

BACKGROUND OF THE INVENTION

The present invention relates to a method of subdividing stacks of superimposed layers, such as paper sheets, into smaller stacks or piles. More particularly, the invention relates to improvements in a method of subdividing a series of successive stacks into smaller stacks or piles by resort to a substantially wedge-like or sword-like tool, e.g., a tool of the type disclosed in my commonly owned U.S. Pat. No. 4,313,703 granted Feb. 2, 1982 for "Apparatus for breaking up stacks of paper sheets or the like". The disclosure of this patent is incorporated herein by reference.

My aforesaid patent discloses an apparatus wherein the stack which is to be divided into two or more smaller stacks or piles is held between the jaws of a tongs in such a way that the reciprocable tool can penetrate into one edge face of the stack. The patented apparatus further comprises an adjustable eccentric cam which can select the position of the tongs with reference to the path of movement of the tool to thus vary the number of sheets in the piles which are obtained on penetration of the tool into the edge face of the stack between the jaws of the tongs. Once the tool has penetrated into the stack, the resulting piles are removed one after the other.

Adjustability of the tongs with reference to the path of movement of the tool is desirable, even if the number of sheets or layers in successive stacks of a short or long series of stacks is constant, because this does not always and invariably ensure that successive stacks will be broken up into piles of identical height or into piles containing identical numbers of layers or sheets. This is due to the fact that the thickness of layers or sheets in successive stacks can vary within a given (and often very wide) range. In order to counteract the effect of varying thickness of layers or sheets upon the thicknesses or height of piles, it was already proposed to carry out an additional dividing operation. The apparatus of my aforementioned patent is constructed and assembled in such a way that the additional dividing operation or step can be dispensed with by providing means for lowering the last pile of a freshly divided stack prior to removal from the tongs so that the tool is invariably free to advance to a level above the topmost layer or sheet of the last pile. Such apparatus has found widespread acceptance in the paper processing industries in spite of the fact that it cannot always ensure the subdivision of successive stacks into piles of predetermined thickness. On the other hand, it is often desirable or necessary to guarantee that the number of layers or sheets in each of the piles which are obtained on subdivision of a stack will be the same. As a rule, the last pile of a stack which is treated in the patented apparatus will contain a number of layers or sheets which deviates, often appreciably, from the number of layers in the other pile or piles of the same stack. Such deviations are not always acceptable, e.g., when the stacks must be broken up into piles each of which should contain a fixed number of layers or sheets prior to conversion of piles into note books, steno pads, exercise books or like stationery products having numbered pages whose total number must or should match a given value.

OBJECTS AND SUMMARY OF THE INVENTION

An object of the invention is to provide a novel and improved method of subdividing stacks of superimposed layers or sheets into smaller stacks or piles with a heretofore unmatched degree of accuracy and reproducibility and without resort to unnecessary or superfluous steps or operations.

Another object of the invention is to provide a method which can ensure that, when successive stacks contain identical numbers of layers or sheets but their thicknesses deviate from a standard value, each such stack is invariably subdivided into piles having identical or at least nearly identical numbers of layers or sheets.

A further object of the invention is to provide a method which is more reliable than the methods which can be practiced with conventional apparatus, and to provide an apparatus for the practice of such method.

The invention resides in the provision of a method of subdividing a stack of superimposed layers, such as paper sheets, into a plurality of smaller stacks with a substantially wedge-like or sword-like dividing tool which is movable between the layers of the stack to thereby subdivide the stack into smaller stacks or piles. The method comprises the steps of monitoring the thickness of the stack and automatically generating a signal denoting the monitored thickness, comparing the monitored thickness with a predetermined value (e.g., by comparing the aforementioned automatically generated signal with a reference signal), and changing the relative positions of the stack and tool prior to penetration of the tool into the stack so as to enable the tool to penetrate between selected layers of the stack (and to thus subdivide the stack into smaller stacks or piles having desired thicknesses) when the monitored thickness of the stack deviates from the predetermined value. The changing step can comprise shifting the stack with reference to the tool. The method can further comprise the step of moving the tool in a predetermined direction to thus effect its penetration into the stack subsequent to completion of the shifting step, and such shifting step then preferably includes displacing the stack substantially at right angles to the direction of movement of the tool.

The monitoring step can include mechanically scanning the thickness of the stack, and the method preferably further comprises the step of mechanically conpacting the stack with a predetermined force in the course of the monitoring step.

The method can further comprise the steps of advancing the stack to a predetermined location (such as a dividing station) upon completion of the monitoring step and separately removing smaller stacks or piles from the predetermined location, e.g., with assistance from the tool. In accordance with a presently preferred embodiment of the method, the stack is advanced from a predetermined first location (monitoring station) to a predetermined second location (the aforementioned dividing station) subsequent to completion of the monitoring step but prior to penetration of the tool into the freshly monitored stack.

The novel features which are considered as characteristic of the invention are set forth in particular in the appended claims. The apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary schematic partly elevational and partly sectional view of a stack dividing apparatus which is designed to break up successive stacks of a series of stacks into pairs of smaller stacks or piles.

DESCRIPTION OF THE PREFERRED EMBODIMENTS

Apparatus for subdividing stacks of paper sheets or the like into smaller or thinner stacks or piles are known in the art of making pads, note books or the like. Therefore, the drawing merely shows those component parts of the apparatus which are needed for proper understanding of the presently preferred embodiments of the method.

The drawing shows an apparatus which serves to subdivide stacks 1 of overlapping paper sheets into pairs of 2 smaller or thinner stacks or piles. The apparatus comprises a pair of spaced-apart strip-shaped guiding members 2 (only one shown) which define an elongated path for transport of successive stacks 1 and of portions (piles) of such stacks in a direction to the right, as viewed in the drawing. The conveyor 80 which transports successive stacks 1 into the path defined by the guiding strips 2 includes an endless belt, an endless chain or any other suitable means which can deliver successive stacks 1 into the path between the guiding members 2. These members define a transversely extending step 3 serving as a back support for that stack (lA) which is in the process of being subdivided or broken up into a pair of thinner stacks or piles at a dividing station or location 5.

The apparatus further comprises a stack supporting means or tongs 4 which serves to grip the outermost layers or sheets of the front or foremost stack lA, namely, of that stack which is located at the station 5 and whose rear edge face abuts against the step 3. The stack-engaging members or jaws 7 and 8 of the tongs 4 are rotary idler rollers which engage the front stack 1 in the region (at the opposite sides) of its leading edge face EF, namely, in that region where a wedge-like dividing tool or sword 6 is caused to penetrate into the foremost stack lA to thereby initiate the subdivision of such stack into a pair of thinner stacks or piles. The lower roller or jaw 7 is mounted at the free end of the shorter arm of a bell crank lever 11 which is pivotable about the axis of a pin 9 secured to the frame of the apparatus. The arrangement is such that, when the lever 11 is caused to pivot in a clockwise direction, as viewed in the drawing, the roller 7 descends along an arcuate path (i.e., it has a component of movement at right angles to the (horizontal) direction (arrow D) of reciprocatory movement of the sword 6 into or from the space between the rollers 7 and 8, i.e., into and out of the tongs 4). Such component of movement is also normal or substantially normal to the planes of layers or sheets in the foremost stack lA.

The upper roller or jaw 8 of the tongs 4 is mounted on a holder 13 which is movable up and down along an upright post 12. The upper end portion of the post 12 is mounted in a support 14 which is secured to the frame. A helical spring 16 reacts against the support 14 and bears against the holder 13 so that the latter urges the roller 8 against the exposed upper side of the uppermost layer or sheet of that stack lA whose rear edge face abuts against the step 3. The underside of the holder 13 is formed with a forwardly and downwardly inclined guide face 17 which is engaged by the leading edge face EF of the foremost stack lA during advancement of such stack from a monitoring station (on the step 3) to the dividing station 5 whereby the holder 13 and its roller 8 are lifted against the opposition of the spring 16.

The bell crank lever 11 which carries the lower roller 7 is biased by a coil spring 18 which urges its lower arm against the periphery of an adjustable eccentric stop 19 mounted on a shaft 20 which is rotatable in the frame to thereby select the uppermost level of the topmost portion of the roller 7. The means for turning the shaft 20 in the frame clockwise or counterclockwise, and for releasably fixing the shaft 20 and eccentric stop 19 in a selected angular position, comprises an electric motor 15 in the drawing.

The downwardly extending longer arm of the lever 11 carries a roller follower 21 which cooperates with a rotary disc cam 22 mounted on a camshaft 23. The latter can be rotated by a gear train 24 including a larger gear **24*a* on the shaft 23 and a smaller gear 24*b* on the output shaft 25 of an electric motor or another main prime mover of the apparatus. The peripheral cam face of the cam 22 has a flat section 22*a* which allows the lever 11 to engage the eccentric stop 19 under the action of the spring 18. The other section 22*b* of the cam face of the cam 22 has a circular outline and serves to maintain the lower roller 7 of the tongs 4 in a retracted position in which the spring 18 stores energy because the lower arm of the lever 11 does not contact the eccentric stop 19**.

The ratio of the gears **24*a* and 24*b* is two-to-one, i.e., the cam 22 completes one-half of a full revolution in response to rotation of the output element 25** through a full revolution.

The sword 6 is secured to a moving means here shown as a slide or carriage 26 which is a platen reciprocable along several horizontal tie rods(the drawing shows two tie rods numbered 27 and 28) mounted in the frame. The directions in which the carriage 26 is reciprocable along the tie rods 27 and 28 are indicated by a double-headed arrow 29. The carriage 26 further supports an adjustable gripper 31 which forms part of a second tongs or pincers 32 further including the dividing sword 6. The carriage 26 and the pincers 32 thereon constitute a conveyor 33 which serves to move divided (thinner) stacks or piles of paper sheets away from the dividing station 5, i.e., in a direction to the right, as viewed in the drawing, and into the range of a conveyor system (not shown) which transports the piles to the next processing station, e.g., to a station where the sheets of each pile are formed with a row of perforations for insertion of spiral binders or the like in order to convert the piles into note books, pads, calendars or the like.

The details of a carriage which can be used in the illustrated apparatus are disclosed, for example, in German Auslegeschrift No. 2,225,063 to which reference may be had, if necessary. The sole notable difference between the carriage which is described in the German publication and the carriage 26 of the illustrated apparatus is that the adjustable gripper of the pincers on the carriage of the German publication is located at a level above the dividing sword; however, the purpose of the pincers on the carriage of the German publication is the same.

The drawing further shows the means for synchronizing the movements of the carriage 26 with movements of the lower roller 7 of the tongs 4, i.e., with angular movements of the cam 22. Such synchronizing means includes a disc 34 which is driven by the output element 25 of the prime mover and carries an eccentric pin 36 coupled to a link 37 which is articulately connected to one end of a two-armed lever 38. The latter is fulcrumed in the frame, as at 41, and its upper end portion (as viewed in the drawing) is articulately connected to the carriage 26 by a link 39.

The dividing sword 6 further cooperates with a lever 43 which is pivotally secured to the support 14, as at 45, and whose lower end portion comprises bifurcated prongs 43*a* receivable in complementary recesses or grooves 44 of the sword 6. The means for pivoting the lever 43 back and forth in the directions indicated by a double-headed arrow 42 is not specifically shown in the drawing. In its presently preferred form, such means for reciprocating the lever 43 (in synchronism with the sword 6) can be constituted by the sword or comprises a suitable cam receiving motion from the output shaft 25 or from a part which is driven by the shaft 25.

The parts 11, 21 and 22 constitute a means for moving the roller 7 relative to the sword 6 in such a way that the roller 7 has a component of movement at right angles to the planes of sheets in the stack between the rollers 7 and 8. The parts 34 and 36–39 synchronize the movements of the moving means (carriage 26) for the sword 6 with the movements of the roller 7 relative to the roller 8 and sword 6.

The apparatus further comprises means 51 for monitoring the thickness or height of successive stacks 1 which are to be broken up or subdivided by the sword 6. The monitoring means 51 comprises a mechanical sensor 52 which is a ram reciprocable up and down in the directions indicated by a double-headed arrow 54 and guided by a holder 53. A coil spring 57 surrounds the upwardly extending shank of the sensor 52 and reacts against the underside of the holder 53. The lowermost convolution of the spring 57 bears against the enlarged lower end portion of the sensor 52 and urges the latter against the topmost sheet of the undivided layer 1 which is located at the monitoring station and is about to enter the dividing station 5, i.e., against the topmost sheet of the layer which is still located at a level above the step 3 and outside of the station 5. The upper portion of the shank of the sensor 52 carries an annular abutment member 58 constituting a stop and preventing, among other functions, separation of the sensor 52 from its holder 53. The abutment 58 is disposed below the upper end of the shank of the sensor which cooperates with a dial gauge 59 mounted on the holder 53 and having a pointer which is rotatable by a shaft 61 to any one of a number of different angular positions each denoting a different thickness or height of the stack 1 below the sensor 52. The shaft 61 of the pointer is connected with a potentiometer forming part of the gauge 59 and serving to transmit signals denoting the monitored thicknesses of successive stacks 1.

The holder 53 is reciprocable along a vertical tie rod or column 62 whose upper end is secured to the frame of the apparatus. A fluid-operated (preferably pneumatic) disengaging motor 63 is provided to move the holder 53 up and down (note the double-headed arrow 64) along the tie rod 62. To this end, the cylinder of the disengaging motor 63 is articulately connected to the frame and the piston rod of the motor 63 is articulately connected to the lower portion of the holder 53, namely, to that portion of the holder which guides the shank of the sensor 52. The lower end portion 66 of the tie rod 62 is enlarged to arrest the holder 53 in a predetermined lower end position. The disengaging motor 63 further constitutes a means for normally biasing the holder 53 against the lower end portion 66 of the tie rod 62.

The potentiometer of the gauge 59 is connected with one input of a signal comparing stage 69 another input of which is connected to a source 71 of reference signals, e.g., an adjustable potentiometer. The stage 69 transmits signals to an adjusting circuit 67. The output of the stage 69 is connected with one input of a memory 72 which is connected to the motor 15 serving to rotate the eccentric 19 in order to change the angular position of the lever 11 and the level of the jaw 7. The parts 11, 15, 19 and 20 can be said to constitute an adjustable means 68 for changing the position of the lower jaw or roller 7 of the tongs 4 relative to the path of the sword 6, i.e., for moving the jaw 7 to any one of a plurality of different positions with reference to the level of the tip of the sword 6. The reference character 73 denotes a timing unit which causes the memory 72 to accept signals from the signal comparing stage 69 at certain intervals. The unit 73 can receive pulses from a device which is driven by or operates in synchronism with the output shaft 25 of the prime mover. The connection between the output of the memory 72 and the motor 15 comprises a control circuit 74 which ensures that the angular position of the cam 19 does not change during the intervals between transmission of successive timing pulses from the unit 73 to the memory 72.

The operation is as follows:

In the illustrated embodiment, the height of the stacks 1 is selected in such a way that each stack requires only one treatment, i.e., each stack 1 is to be subdivided into no more than two smaller stacks or piles. If a stack is taller than the combined desired height of two smaller stacks or piles, the apparatus is modified in a manner as disclosed in the aforediscussed U.S. Pat. No. 4,313,703.

Shortly before a fresh stack 1 enters the subdividing station 5, the timing unit 73 transmits a pulse to the memory 72 so that the memory can transmit a signal, previously received from the signal comparing stage 69, to the motor 15 via control circuit 74. The stage 69 transmits a signal if the height of the stack 1 below the sensor 52 deviates from the prescribed height, i.e., if the intensity and/or another characteristic of the signal from the potentiometer of the gauge 59 deviates from the reference signal which is supplied by the source 71. The motor 15 is a stepping motor and changes the angular position of the shaft 20 and cam 19 in dependency on the intensity of the positive or negative signal supplied by the control circuit 74. As mentioned above, the angular position of the shaft 20 remains unchanged if the potentiometer of the gauge 59 transmits to the stage 69 a signal denoting that the height of the stack 1 below the sensor 52 is normal. If the height of the stack 1 below the sensor 52 is too low, the motor 15 rotates the shaft 20 and the cam 19 in a counterclockwise direction, as viewed in the drawing. The shaft 20 is rotated clockwise if the height of the stack 1 below the sensor 52 is excessive (i.e., greater than that denoted by the intensity of the reference signal which is furnished by the source 71). If the shaft 20 is rotated in a counterclockwise direction, the roller or jaw 7 is lifted through a distance corresponding to half the deviation between the actual height of the stack 1 below the sensor 52 and the desired height. If the height of the stack 1 below the sensor 52 is excessive, the motor 15 causes the cam 19 and the spring 18 to lower the roller or jaw 7 through a distance corresponding to half the deviation between the (excessive) height of the monitored stack and the desired height.

In the next step, the disengaging motor 63 is activated by a control unit which is not specifically shown in the drawing and which can derive motion from the control circuit 74 or from the output shaft 25, whereby the motor 63 lifts the holder 53 which latter engages the underside of the abutment 58 and lifts the sensor 52 above and away from the uppermost sheet of the stack 1 therebelow. The conveyor 80 then advances the freshly monitored stack 1 into the dividing station 5, i.e., into the tongs 4, whereby the front edge face EF of the stack slides along the cam face 17 and lifts the upper jaw 8 of the tongs 4. The stack 1 comes to rest when it descends along the step 3 and assumes the position of the stack 1A shown in the drawing, i.e., its front portion is then disposed between the jaws 7 and 8 of the tongs 4. During such movement, the stack 1A slides along the guiding means 2. At the same time, a fresh stack 1 advances into the space below the raised sensor 52, the disengaging motor 63 thereupon lowers the holder 53, and the latter moves away from the abutment 58 so that the spring 57 can move the lower end portion of the sensor 52 into requisite engagement with the topmost sheet of the fresh stack 1, i.e., the signal which the signal comparing stage 69 receives from the potentiometer of the gauge 59 is indicative of the height of the stack below the sensor 52. The spring 57 ensures that each freshly delivered stack is engaged by the lower end portion of the sensor 52 with the same force.

The adjustable gripper 31 then assumes the angular position which is shown in the drawing and the carriage 26 moves the sword 6 toward the tongs 4 so that the tip of the sword penetrates into the stack 1A between the jaws 7, 8 immediately or shortly before the portion **22*p* of the peripheral surface of the cam 22 (which rotates in a counterclockwise direction, as viewed in the drawing) reaches the roller follower 21 at the lower end of the longer arm of the lever 11. The section 22*b* of the cam face on the cam 22 then pivots the lever 11 in a clockwise direction to thereby move the jaw 7 to a lower level, i.e., to disengage the lever from the eccentric cam 19. In other words, the tongs 4 opens and enables the sword 6 to readily penetrate deeper between selected layers of the stack 1A. The advancing sword 6 can pivot the lever 43 in a clockwise direction whereby the bifurcated prong 43*a* enters the recesses 44 and ultimately supports the front end portion of the separated upper pile of the freshly split stack 1A. The lower pile of such stack is engaged by the tongs or pincers 32 including the sword 6 and the gripper 31. The tongs 32 closes before the carriage 26 begins to move the sword 6 back toward the position which is shown in the drawing, whereby the tongs 32 entrains the lower pile of the stack 1A. The lever 43 is pivoted back to the illustrated position upon retraction of the sword 6 from the tongs 4 whereby the upper pile of the split stack 1A descends onto the lower jaw 7 which is still maintained in the lowered position because the follower 21 continues to track the circular section 22*b* of the face on the cam 22**. Such tracking continues until the respective working cycle is completed.

When the tongs 32 have completed the removal of the lower pile of the freshly split stack 1A, its gripper 31 is returned to the illustrated (open) position and the carriage 26 returns the sword 6 to its left-hand end position so that the tongs 32 can engage the remaining (upper) pile of the stack 1A, namely, the pile which then rests on the lowered roll 7. Since the roll 7 is still maintained in its lowered position, the sword 6 can readily slide over the top of the remaining pile of the stack 1A and engages the jaw 8 to lift the holder 13 on its way to the position in which the gripper 31 is pivoted to engage the remaining pile of the stack 1A from below preparatory to extraction of such remaining pile from the tongs 4 as a result of renewed rightward movement of the carriage 26 with the sword 6 and gripper 31. At the same time, or shortly thereafter, a fresh stack 1 is caused to advance over the step 3 and into the dividing station 5, i.e., into the tongs 4. At such time, the section **22*b* of the cam face moves beyond the follower 21 so that the lower arm of the lever 11 can return into engagement with the cam 19 under the action of the spring 18. The cam 19 changes its angular position if the monitoring of the thickness of the freshly supplied stack 1 (from the station below the sensor 52 into the dividing station 5) warrants an adjustment. The aforedescribed sequence of operations is then repeated with the stack which occupies the station 5**.

If a stack is to be subdivided into three or more smaller stacks or piles, the apparatus which is shown in the drawing can be modified in a manner as shown in FIG. 2 of my aforementioned U.S. Pat. No. 4,313,703, i e., the cam 22 is replaced with a cam whose peripheral surface has several alternating convex and concave sections and which is driven by an appropriate step-down transmission.

It is further possible to replace the adjusting circuit 67 with an adjusting means including a computer which receives signals from the potentiometer of the gauge 59 and initiates subdivision of each stack 1 into two or more smaller stacks or piles having identical or different heights.

An important advantage of the improved method is that the position of the tip of the sword 6 with reference to the stack 1A between the jaws 7 and 8 of the tongs 4 can be selected with a surprisingly high degree of accuracy. This is attributable, at least to a certain extent, to the provision of a mechanical monitoring means (51) whose sensor 52 is biased downwardly and against the topmost layer or sheet of the stack 1 therebelow with a predetermined force (spring 57) so that the monitoring action is very reliable. If successive stacks of a short or long series of stacks contain identical numbers of layers or sheets, but have different thicknesses, the improved apparatus ensures that each pile of a subdivided stack contains a predetermined number of layers.

The placing of the monitoring means 51 upstream of the dividing station 5 is considered to be desirable and advantageous because the height or thickness of a stack (1) on the step 3 can be ascertained while the sword 6 is in the process of subdividing the preceding stack (1A). The sensor 52 can ascertain the thicknesses of successive stacks while such stacks are in motion from the conveyor 80 toward and into the dividing station 5.

The cam 22 performs the function of ensuring that the sword 6 can readily penetrate into the stack 1A at the dividing station 5 by moving the lever 11 away from the stop 19 (i.e., by lowering the jaw 7 below the level which is selected by the position changing means 68) immediately or shortly after the tip of the sword enters between two selected layers of the stack in the tongs 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. A method of subdividing each of a succession of first stacks of superimposed layers, such as paper sheets, into a plurality of identical smaller stacks with a tool which is movable between the layers of the first stacks and forms part of a subdividing apparatus, comprising the steps of advancing by a conveyor of the subdividing apparatus successive first stacks onto a support at a dividing station of the subdividing apparatus; monitoring the thickness of the first stack at said station by a signal monitoring means of the subdividing apparatus; comparing the signals denoting the monitored thickness of the first stack at said station with a signal denoting a predetermined value; maintaining the first stack at said station and the tool at predetermined levels relative to each other and causing the tool to penetrate into the first stack at said station under the action of tool moving means of the subdividing apparatus so as to subdivide the first stack into identical smaller stacks when the monitored thickness of the first stack at said station matches said predetermined value; and automatically changing the relative levels of the first stack at said station and the tool by adjustable position changing means of the subdividing apparatus prior to penetration of the tool into the first stack at said station, so as to enable the tool to penetrate between selected layers of the first stack and to subdivide the first stack at said station into identical smaller stacks, when the monitored thickness of the first stack at said station deviates from said predetermined value.

2. The method of claim 1, wherein said changing step comprises shifting the first stack at said station with reference to the tool.

3. The method of claim 2, further comprising the step of moving the tool in a predetermined direction to effect its penetration into the first stack at said station subsequent to completion of said shifting step, said shifting step including displacing the first stack at said station substantially at right angles to said direction.

4. The method of claim 3, wherein said monitoring step includes mechanically scanning the thickness of the first stack at said station.

5. The method of claim 1, further comprising the steps of advancing successive first stacks from said station to a predetermined location upon completion of said monitoring step and separately removing smaller stacks from said location.

6. The method of claim 1, further comprising the step of mechanically compacting the first stack at said station with a predetermined force in the course of said monitoring step.

7. The method of claim 1, further comprising the step of advancing successive first stacks at said station from a predetermined first to a predetermined second location subsequent to the monitoring step but prior to penetration of the tool into the first stack at said station.

* * * * *